US006267088B1

(12) United States Patent
Rosskamp et al.

(10) Patent No.: US 6,267,088 B1
(45) Date of Patent: Jul. 31, 2001

(54) TWO-STROKE ENGINE HAVING AN AIR SCAVENGED TRANSFER CHANNEL

(75) Inventors: Heiko Rosskamp, Addberg; Axel Klimmek, Schwaikheim; Lars Bergmann, Waiblingen, all of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/644,714

(22) Filed: Aug. 24, 2000

(30) Foreign Application Priority Data

Aug. 25, 1999 (DE) ..... 199 40 180
Sep. 15, 1999 (DE) ..... 199 44 214

(51) Int. Cl.[7] ..... F02B 25/22
(52) U.S. Cl. ..... 123/73 PP; 123/65 P
(58) Field of Search ..... 123/73 PP, 73 R, 123/73 A, 73 AA, 74 A, 74 AA, 65 A, 65 P

(56) References Cited

U.S. PATENT DOCUMENTS 5,379,732 * 1/1995 Mavinahally et al. ..... 123/73 AA
5,628,295 * 5/1997 Todero et al. ..... 123/73 AA
5,899,177 * 5/1999 Binversie et al. ..... 123/65 A
6,101,991 * 8/2000 Glover ..... 123/73 PP

FOREIGN PATENT DOCUMENTS 0 933 514 8/1999 (EP) .

* cited by examiner

*Primary Examiner*—Marguerite McMahon
(74) *Attorney, Agent, or Firm*—Walter Ottesen

(57) ABSTRACT

The invention relates to a two-stroke engine which operates as a drive motor in a portable work apparatus such as a motor-driven chain saw. The two-stroke engine has a combustion chamber (3) which is formed in a cylinder (2) and is delimited by a piston (5) which moves up and down in the cylinder. The piston drives via a connecting rod (6) a crankshaft (7) which rotates in a crankcase (4). The crankcase (4) is connected to the combustion chamber (3) via a transfer channel (14). A first end (20) of the transfer channel (14) opens via an entry window (12) into the combustion chamber (3) and the second end (19) of the transfer channel (14) opens into the crankcase (4). The entry window (12) lies in the cylinder wall (16) and is controlled by the piston (5). The transfer channel (14) is connected to a gas channel (22) between its ends (19, 20). An essentially fuel-free gas flow (40) flows via a check valve (21) from the gas channel (22) and flows into the transfer channel (14). The mixture, which is necessary for operating the two-stroke engine (1), is drawn from a membrane carburetor (8) into the crankcase (4) via an inlet (11). The flow element (23, 33, 45) is mounted in the flow path of the gas flow (40) which exits from the gas channel (22) into the transfer channel (14). A flow element fans out the gas flow (40). In this way, a complete scavenging of the transfer channel is ensured during the induction stroke.

15 Claims, 4 Drawing Sheets

TWO-STROKE ENGINE HAVING AN AIR SCAVENGED TRANSFER CHANNEL

FIELD OF THE INVENTION

The invention relates to a two-stroke engine which is used especially as a drive motor in a portable handheld work apparatus such as a motor-driven chain saw, brushcutter, cutoff machine, blower apparatus or the like.

BACKGROUND OF THE INVENTION

A two-stroke engine of this kind is disclosed in international patent publication WO98/17901 and includes a combustion chamber defined by a cylinder and delimited by a reciprocating piston. The crankcase is connected to the combustion chamber via transfer channels. The first end of a transfer channel faces toward the cylinder and opens into the combustion chamber via an entry window lying in the cylinder wall and the lower second end of the transfer channel opens to the crankcase. The entry window of the transfer channel, which lies in the cylinder wall, is controlled by the piston in the manner of a slot control, that is, the entry window is opened or closed in dependence upon the stroke position of the piston.

The air/fuel mixture, which is necessary to operate the engine, is drawn in by suction through a mixture-preparation device and an inlet into the crankcase and, with a downward travel of the piston, is pushed into the combustion chamber via the transfer channels. To reduce the exhaust-gas emissions, fuel-free gas, especially air, is provided in the transfer channels arranged to the right and to the left of the outlet. This fuel-free gas is supplied to the transfer channels via respective gas channels.

In the induction stroke, and with the piston traveling upwards in the direction of top dead center, a mixture is drawn by suction into the crankcase, on the one hand, via the inlet from the mixture-preparation device; on the other hand, fuel-free air flows into the crankcase via the transfer channels from the gas channel. With the downwards travel of the piston in the direction of bottom dead center, the mixture is displaced from the crankcase via the transfer channels into the combustion chamber. For an operation as a scavenging engine, first, because of the charge of the transfer channels with air, fuel-free air flows into the combustion chamber ahead of the air/fuel mixture whereby the scavenging losses are reduced. In a subsequent upward stroke, residual amounts of the air/fuel mixture remain in the transfer channel from the previous stroke. These residual amounts are scavenged with fuel-free gas, especially air, in a next induction stroke. In practice, it has been shown that the inflowing gas flow of fuel-free air cannot always ensure a complete scavenging of the transfer channel so that residual amounts of the air/fuel mixture of a previous stroke enter the combustion chamber in a subsequent stroke together with the fuel-free air. For this reason, the scavenging losses increase. Because of the incomplete scavenging of the transfer channels with the fuel-free gas, the desired low exhaust-gas emissions often cannot be maintained.

SUMMARY OF THE INVENTION

It is an object of the invention to provide a two-stroke engine of the kind referred to above which is so improved that a complete scavenging of the transfer channels with fuel-free gas, especially air, is ensured.

The two-stroke engine of the invention includes a two-stroke engine in a portable handheld work apparatus. The two-stroke engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; at least one transfer channel connecting the crankcase to the combustion chamber; the transfer channel having a first end defining an entry window opening into the combustion chamber; the entry window being formed in the cylinder wall and being controlled by the piston as the piston moves in the cylinder; the transfer channel having a second end opening into the crankcase; a gas channel for supplying essentially fuel-free gas flow to the engine; a check valve for connecting the gas channel to the transfer channel at a location thereon between the first and second ends so as to permit the fuel-free gas flow to flow from the gas channel into the transfer channel; a mixture-preparation device for supplying an air/fuel mixture; an intake channel for conducting the air/fuel mixture into the crankcase; the gas channel, the check valve and the transfer channel conjointly defining a flow path for the fuel-free gas flow; and, a flow element arranged along the flow path for fanning out the fuel-free gas flow.

The essentially fuel-free gas flow which flows from the gas channel into the transfer channel is broadly fanned out by the flow element provided according to the invention whereby the total cross section of the transfer channel is charged over its entire length with component flows flowing in various directions. In this way, a complete scavenging of the transfer channel with fuel-free gas is ensured within the shortest time. Even at high engine speeds, a complete scavenging of the transfer channel is ensured.

In a first embodiment of the invention, the flow element, which fans the gas flow, is provided as a recess configured in the roof of the transfer channel toward which the flow is directed. This recess is purposefully to be configured in dependence upon the dimensions of the transfer channel. The gas flow, which enters from the gas channel into the transfer channel, is directed into the recess and is there broken up and swirled by the base and the side walls of the recess so that swirled air masses moved with a high intensity flow from the transfer roof to the crankcase. Because of the air masses moved at high intensity, it is ensured that no penetration of the residual gases, which are present in the transfer channel, results; instead, these residual gases are acted upon over the entire cross section of the transfer passage and are scavenged.

A profiled channel segment of the transfer channel can be used as a flow element which fans out the gas flow. The profiled channel segment lies downstream of the valve in the region toward the crankcase. This profiled channel segment is purposefully approximately at the elevation of the valve and can be formed by a flow body which is mounted on the wall of the transfer channel lying opposite to the valve.

In a further embodiment, the flow element, which fans out the gas flow, can be provided by the configuration of the membrane of the valve configured as a membrane valve. For this purpose, it is provided to configure the portion of the membrane projecting in the longitudinal direction of the transfer channel to be greater than the portion of the membrane projecting transversely to the longitudinal direction of the transfer channel so that already when flowing over into the transfer channel, the gas flow is subdivided into a first component flow directed toward the roof of the transfer channel and second, third and additional component flows flowing laterally over the membrane. The projecting portion on the end of the membrane facing toward the roof of the transfer channel is preferably approximately twice as large as the portions of the membrane projecting to the sides and to the foot of the membrane.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
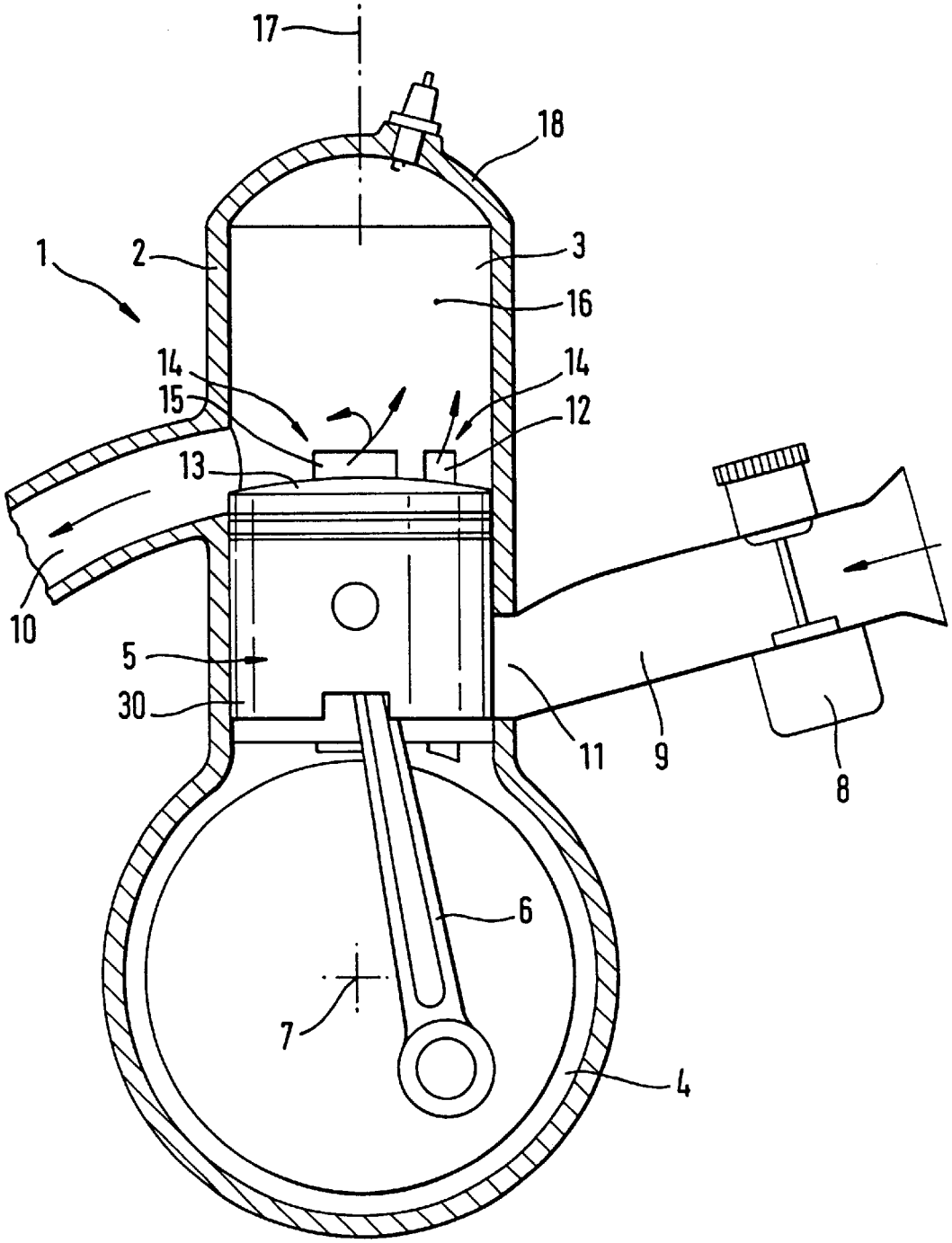
FIG. 1 is a side elevation view, partially in section, of a two-stroke engine having transfer channels lying on opposite sides of the cylinder.

The two-stroke engine 1 shown in FIG. 1 includes essentially a cylinder 2 and a piston 5 movable up and down in the cylinder. The piston 5 imparts rotational movement to a crankshaft 7 via a connecting rod 6. The crankshaft 7 is arranged in a crankcase 4.

A combustion chamber 3 is formed in the cylinder 2 and this chamber is delimited by the base 13 of the piston 5. The combustion chamber 3 includes an outlet 10 through which the combustion gases are directed away after a work stroke. The air/fuel mixture, which is needed to operate the engine 1, is supplied to the crankcase 4 from a mixture-preparation device 8 via an inlet 11 and an intake channel 9. The mixture-preparation device 8 is preferably a membrane carburetor.

In the embodiment shown, the inlet 11 is controlled by the wall 30 of the piston 5. In the stroke position of the piston shown in FIG. 1, the inlet 11 is completely closed by the piston wall 30. The air/fuel mixture, which is inducted into the crankcase 4, is therefore compressed by the further downward movement of the piston in the direction toward bottom dead center and flows over into the combustion chamber 3 via a transfer channel 14 and an entry window 12 in the cylinder wall 16. Only one of the transfer channels is shown in FIG. 2 and the entry window 15 in FIG. 1 corresponds to another transfer channel on the side of the cylinder shown in FIG. 1.

As can be seen in FIG. 1, there are two transfer channels 14 arranged on each side of the outlet 10 so that a two-stroke engine, which is configured in this manner, can be operated with appropriate control as a scavenging engine as well as a stratified charge engine.

Figure 2:
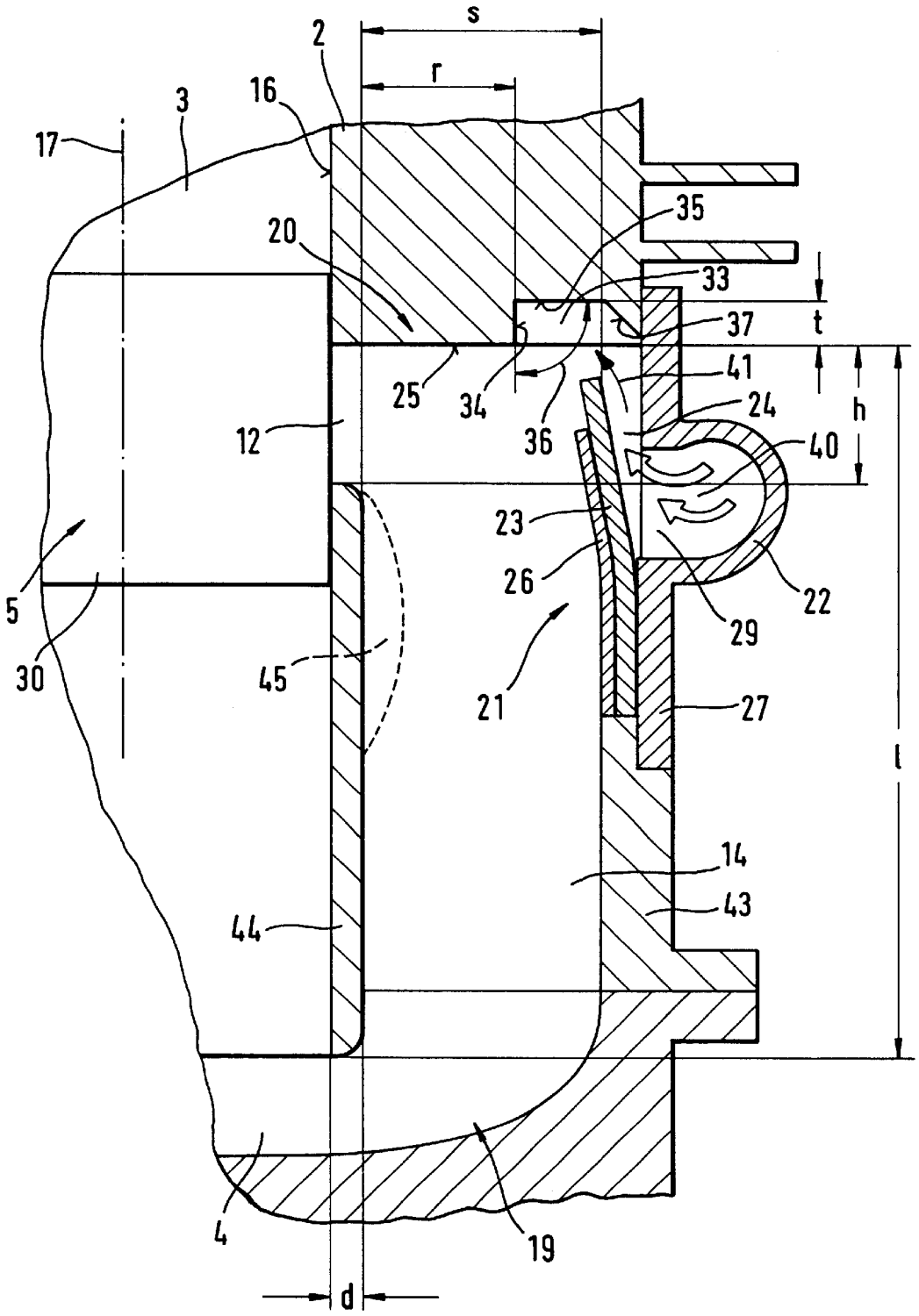
FIG. 2 is a detail longitudinal section taken through a transfer channel formed in the cylinder of the engine shown in FIG. 1.

In the embodiment shown, each transfer channel 14 runs in the cylinder wall essentially parallel to the cylinder axis 17 as can especially be seen in FIG. 2. The transfer channel 14 can also have a configuration which departs from the embodiment shown so that, for example, the transfer channel can run curved in the direction of flow.

The first end 20 of the transfer channel 14 faces toward the cylinder head 19 and opens into the combustion chamber 3 via the entry window 12 in the cylinder wall 16; whereas, the second end 19 of the transfer channel 14 faces toward the crankcase 4 and opens toward the crankcase. The other transfer channels of the two-stroke engine 1 are correspondingly configured.

Figure 3:
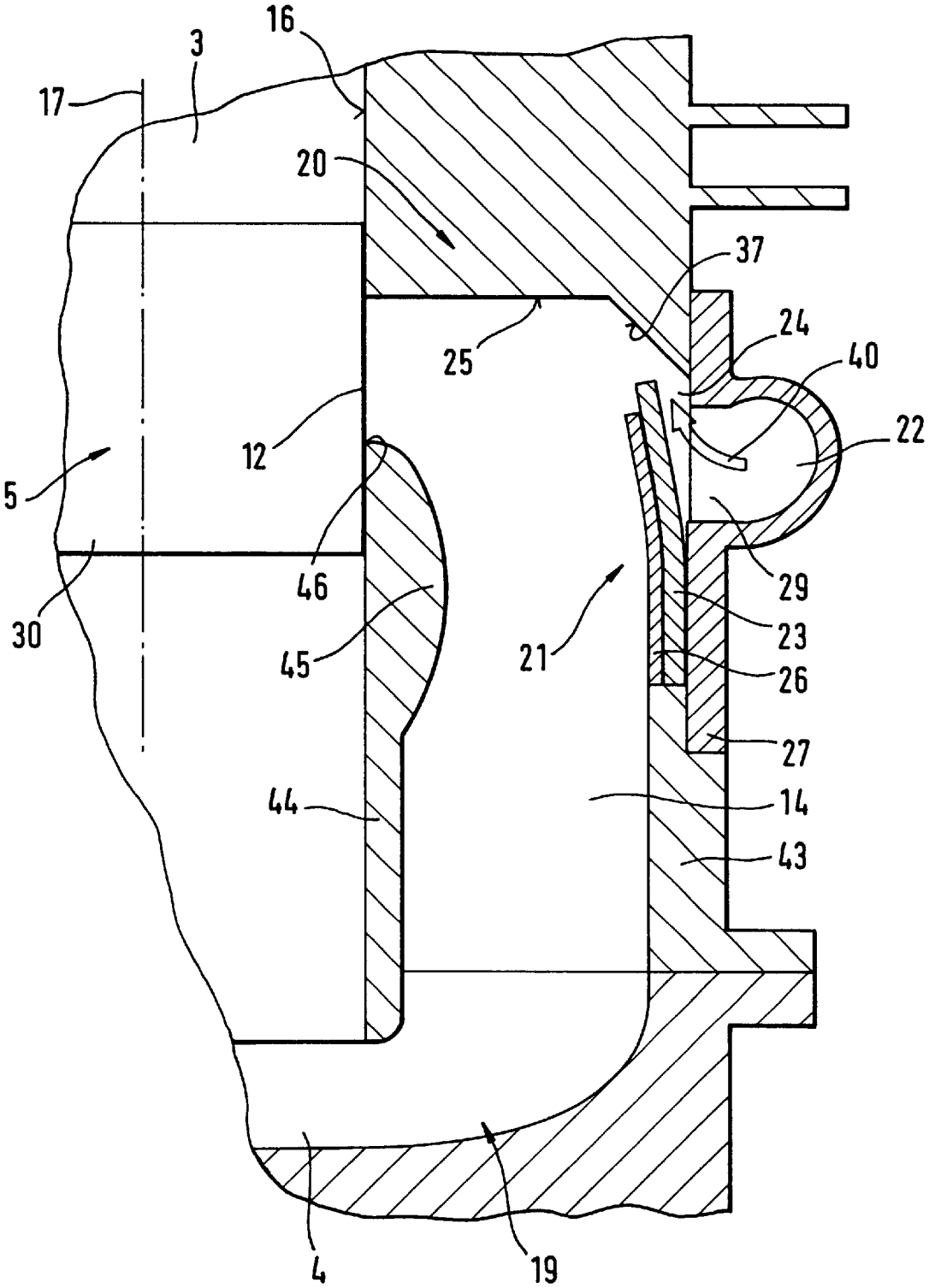
FIG. 3 is a detail longitudinal section view taken through a transfer channel in the manner of FIG. 2 in accordance with another embodiment of the invention.

The transfer channel 14 is connected to a gas channel 22 between the first end 20 and the second end 19. A valve 21 closes the flow connection between the gas channel 22 and the transfer channel 14. The valve 21 opens into the transfer channel 14 and is configured as a check valve, especially a membrane valve, in the embodiments shown. As shown in FIGS. 2 and 3, the membrane 23 clears an outlet slit 24 in the open position which lies facing toward the roof 25 of the transfer channel 14. In the open position shown, the membrane 23 is held by a supporting sheet metal element 26 with which the membrane is attached to a separate component 27 in which the gas channel 22 is also formed.

Figure 4:
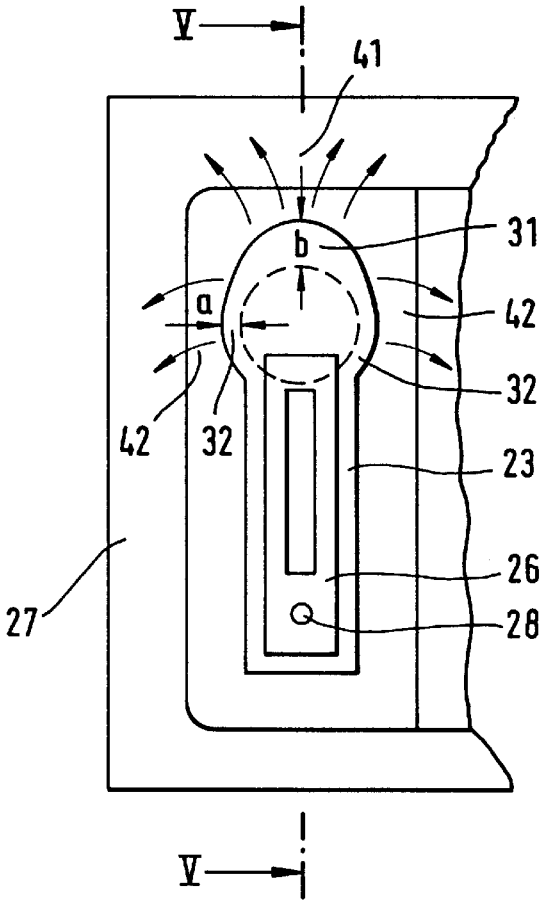
FIG. 4 is a plan view of a check valve opening into the transfer channel; and, FIG. 5 is a section view taken through the check valve of FIG. 4 along line V—V of FIG. 4.
Figure 5:
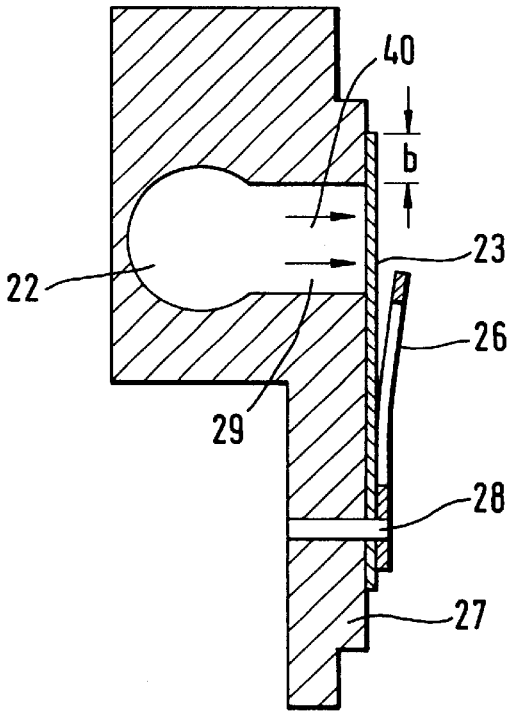

As shown in FIGS. 4 and 5, the seal membrane 23 together with the support element 26 is attached by a common attachment pin 28 to the inner side of the component 27. This inner side lies opposite the transfer channel 14. In the closed position of the seal membrane 23 shown in FIG. 5, the inflow bore 29 of the gas channel 22 is closed. The projecting portion 31 of the seal membrane 23 is at the end of the membrane 23 which faces toward the roof 25 of the transfer channel. The projecting portion 31 is configured to have a dimension (b) which is configured to be substantially larger than the lateral projecting portion 32 of the seal membrane having the dimension (a). In this way, the projecting portion 31 of the membrane 23 in the longitudinal direction of the transfer channel 14 is significantly larger than transversely to this longitudinal direction. This has the consequence that the gas flow 40 enters out of the outflow bore 29 into the transfer channel 14 essentially as a three-dimensional gas flow and ensures the complete scavenging of the transfer channel with the fuel-free air. This wide fanning of the gas flow 40 is achieved by the different projecting portions (31, 32) of the seal membrane 23 whereby the gas flow 40 flowing into the transfer channel is subdivided into an upper component flow 41, which is directed toward the transfer channel roof 25 as well as into component flows 42 which flow laterally around the seal membrane 23. In this way, the seal membrane 23 constitutes a flow element which fans out the inflowing fuel-free gas flow because of the different projecting portions (31, 32) thereof.

As shown in FIG. 2, a recess 33 can be provided in the roof 25 of the transfer channel. This recess 33 can be in addition to the configuration of the membrane 23 which fans out the gas flow or can be in lieu of this configuration. The recess 33 functions as a fanning flow element. The recess 33 extends from the outer wall 43 of the transfer channel 14 radially in the direction toward the entry window 12 in the cylinder wall 16. Preferably, the recess 33 extends in the peripheral direction of the cylinder 2 over approximately the entire width of the transfer channel 14.

The component flow 41 exits out of the outlet slit 24 of the check valve 21 and faces toward the roof 25 of the transfer channel. The component flow 41 flows in the direction toward the closed entry window 12 to an end wall 34 of the recess 33 which conjointly defines an angle 36 with the base 35 of the recess. The angle 36 can be approximately 80° to 135°. In the embodiment shown, the angle 36 is 90°. It is selected in correspondence to the flow conditions and the desired fanning of the component flow 41 of the fuel-free gas flow 40. The component flow 41 flows into the recess.

The base 35 of the recess 33 lies preferably approximately parallel to the roof 25 of the transfer channel 14. The radial spacing of the end wall 34 of the recess 33 to the entry window 12 in the cylinder wall 16 is advantageously approximately 60% of the distance (s) of the transfer channel 14. The distance (s) is measured in the radial direction. An effective fanning of the inflowing gas flow is achieved when the recess 33 has a depth (t) which is approximately 6% to 60% of the distance (s) of the transfer channel 14.

In the configuration of the transfer channel 14, it has been shown to be advantageous when the thickness (d) of the wall 44 of the transfer channel 14 corresponds to approximately 50% of the distance (s) of the transfer channel 14. The wall 44 lies opposite the check valve 21 and the distance (s) is measured in the radial elevation direction. Here, a height (h) of the entry window 12 is advantageously approximately 15% to 100% of the radial distance (s) of the transfer channel 14. Furthermore, the ratio of the length (l) of the transfer channel 14 to its radial distance (s) is approximately equal to or greater than five which has been shown to be advantageous. The length (l) is measured in the direction of the cylinder axis 17.

The gas flow 40 is supplied via the gas channel 22. When the gas flow 40 is fanned out by means of a recess 33 having the depth (t) in the transfer channel roof 25, a rapid and complete scavenging of the transfer channel 14 from the entry window 12 to the crankcase 4 is achieved. This is advantageous for achieving low exhaust-gas emissions for an operation of the engine as a scavenging engine as well as for an operation as a stratified layer engine.

The gas flow 40 is essentially fuel free and flows out from the gas channel 22 into the transfer channel 14. In the embodiment of FIG. 3, the channel segment of the transfer channel 14, which leads downstream of the check valve 21 toward the crankcase 4, is configured with a profile to define a flow element for fanning out the gas flow 40. The profile lies approximately at the elevation of the check valve 21 and is defined by a flow body 45 in the embodiment shown. The flow body 45 is provided on the wall 44 of the transfer channel 14 which lies opposite the check valve 21 and projects into the transfer channel 14. The flow body 45 narrows the channel cross section starting at the lower edge 46 of the entry window 12 and extends in the longitudinal direction of the transfer channel up to approximately half the length thereof. Other profiles of the transfer channel 14 can be advantageous for fanning out the fuel-free gas flow exiting from the gas channel.

In a simple configuration, the gas channel is connected to the atmosphere preferably via an air filter so that the fuel-free gas flow is an air flow.

The flow elements described above for fanning and for breaking up the fuel-free gas flow 40 can be configured individually or in combination. In the embodiment of FIG. 2, the check valve 21 is configured to correspond to FIG. 4 and the recess 33 is additionally provided. The profiled channel cross section is indicated by the broken line.

The recess is delimited by a side wall 37 on the side lying opposite the end wall 34 against which the flow impinges. The side wall 37 ends at the component 27 and lies in the longitudinal direction of the transfer channel 14 approximately above the membrane 23 and its support element 26. The side wall 37 serves as a conducting surface for steering the fuel-free gas flow which enters into the transfer channel. In the embodiment of FIG. 2, the side wall 37 serves to conduct the gas flow into the recess 33 and direct the flow approximately toward the end wall 34. In the embodiment of FIG. 3, the conducting surface of the side wall 37 functions as a guide for the gas flow 40 so that the gas flow completely scavenges the region of the transfer channel 14 ahead of the entry window 12.

It is understood that the foregoing description is that of the preferred embodiments of the invention and that various changes and modifications may be made thereto without departing from the spirit and scope of the invention as defined in the appended claims.

What is claimed is:

1. A two-stroke engine including a two-stroke engine in a portable handheld work apparatus, the two-stroke engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

at least one transfer channel connecting said crankcase to said combustion chamber;

said transfer channel having a first end defining an entry window opening into said combustion chamber;

said entry window being formed in said cylinder wall and being controlled by said piston as said piston moves in said cylinder;

said transfer channel having a second end opening into said crankcase;

a gas channel for supplying essentially fuel-free gas flow to said engine;

a valve for connecting said gas channel to said transfer channel at a location thereon between said first and second ends so as to permit said fuel-free gas flow to flow from said gas channel into said transfer channel;

a mixture-preparation device for supplying an air/fuel mixture;

an intake channel for conducting said air/fuel mixture into said crankcase;

said gas channel, said valve and said transfer channel conjointly defining a flow path for said fuel-free gas flow; and, a flow element arranged along said flow path for fanning out said fuel-free gas flow.

2. The two-stroke engine of claim 1, wherein said transfer channel has a predetermined width extending in the peripheral direction of said cylinder and a roof against which said fuel-free gas flow impinges when flowing along said flow path; and, said flow element being a recess formed in said roof and said recess extending over at least a portion of said width.

3. The two-stroke engine of claim 2, wherein said recess extends over approximately all of said width.

4. The two-stroke engine of claim 2, wherein said transfer channel has an outer wall and said recess extends from said outer wall in a direction toward said entry window.

5. The two-stroke engine of claim 2, wherein said recess has a base and an end wall against which said gas flow impinges as said gas flow moves toward said entry window; and, said end wall and said base conjointly defining an angle in a range of approximately 80° to 135°.

6. The two-stroke engine of claim 5, wherein said transfer channel includes a segment extending a distance (s) measured in a radial direction toward said entry window; and, said end wall being at a radial distance (r) from said entry window and said radial distance (r) corresponding to approximately 60% of said distance (s).

7. The two-stroke engine of claim 6, wherein said recess has a depth (t) corresponding to approximately 6% to 60% of said distance (s) measured in said radial direction.

8. The two-stroke engine of claim 5, wherein said base of said recess lies approximately parallel to said roof of said transfer channel.

9. The two-stroke engine of claim 1, wherein said flow element is a profiled segment of said transfer channel leading toward said crankcase and downstream of said valve.

10. The two-stroke engine of claim 9, wherein said profiled segment lies approximately at the elevation of said valve.

11. The two-stroke engine of claim 9, wherein said transfer channel has a wall lying opposite said valve; and, said profiled segment is arranged on said wall lying opposite said valve and is configured to narrow the cross section of said transfer channel.

12. The two-stroke engine of claim 1, wherein said valve is configured as a membrane valve opening toward said transfer channel; and, said membrane valve includes a seal membrane which opens to form an outlet slit through which said fuel-free gas flow passes when entering said transfer channel; and, said outlet slit defines said flow element.

13. The two-stroke engine of claim 12, wherein a first portion of said seal membrane extends in the longitudinal direction of said transfer channel beyond said gas channel and a second portion of said seal membrane extends in a direction transversely to said longitudinal direction beyond said gas channel; and, said first portion being larger than said second portion.

14. The two-stroke engine of claim 12, wherein said transfer channel has a roof against which said fuel-free gas flow impinges when flowing along said flow path; and, said outlet slit opening in a direction facing toward said roof.

15. The two-stroke engine of claim 1, wherein said transfer channel has a predetermined mean flow path length between said first and second ends thereof and the ratio of said length to the distance (s) measured in elevation direction is greater than five.

* * * * *